US005400519A

United States Patent [19]

Meyer

[11] Patent Number: 5,400,519

[45] Date of Patent: Mar. 28, 1995

[54] SIDING APPLICATION AND GAUGE TOOL

[76] Inventor: Glen A. Meyer, 940 N. 10th, Stayton, Oreg. 97383

[21] Appl. No.: 125,079

[22] Filed: Sep. 21, 1993

Related U.S. Application Data

[63] Continuation of Ser. No. 845,615, Mar. 10, 1992, abandoned.

[51] Int. Cl.[6] ..... G01B 3/30

[52] U.S. Cl. ..... 33/646; 33/647

[58] Field of Search ..... 33/647, 646, 648, 649, 33/411; 52/547, 548, 408, 105, 99

[56] References Cited

U.S. PATENT DOCUMENTS

| | | | |
|---|---|---|---|
| 399,898 | 3/1889 | Hosack | 33/647 |
| 652,256 | 6/1900 | Farmer | 33/411 |
| 774,114 | 11/1904 | Spear | 33/646 |
| 1,115,202 | 10/1916 | Ingles | 33/646 |
| 1,598,986 | 9/1926 | Ping | 33/647 |
| 4,208,799 | 6/1980 | Frantello | 33/647 |
| 4,425,714 | 1/1984 | Kelly | 33/646 |
| 4,473,100 | 9/1984 | Wheeler | 33/647 |

OTHER PUBLICATIONS

Popular Mechanics: vol. 103 #6 p. 180 Date Jun. 1955.

*Primary Examiner*—Christopher W. Fulton

*Attorney, Agent, or Firm*—Kolisch Hartwell Dickinson McCormack & Heuser

[57] ABSTRACT

A siding application and gauge tool which permits one person to apply siding to a building. At one end a knife edge or hook is inserted behind the nailed siding. A top ridge is of sufficient width to fit over the top of the nailed siding. The overlap gauge fits adjacent to the nailed siding providing the proper overlap length for the next piece of siding. The material support section with stop, supports the piece of siding in an upright position. The length of the material support section with lip corresponds to the width of the exposed siding.

2 Claims, 2 Drawing Sheets

SIDING APPLICATION AND GAUGE TOOL

This is a continuation of application Ser. No. 07/845615, filed on Mar. 10, 1992, now abandoned.

BACKGROUND OF THE INVENTION

1. Field of Invention

The present invention relates to support hangers and, more particularly, to support hangers and gauges designed to temporily hold one end of a long piece of siding and to measure the overlap and the exposed siding.

2. Prior Art

In the housing industry, teams generally apply siding to a house. This allows for each member of the team to measure the proper overlap of siding and then attach the siding to the side of the home. Generally, the length of the siding prevents one person from performing the job alone. If one person could properly attach the siding, productivity would increase.

While products for permanently attaching wall panels exists, (see, for example, U.S. Pat. No. 4,580,3845, a hooking wall panel clip; and U.S. Pat. No. 4,459,790, curtain wall with cross member pins) no temporary, detachable support for attaching siding has been found. U.S. Pat. No. 4,972,647 discloses permanently attached shims to siding to improve the aesthetic appearance.

SUMMARY OF THE INVENTION

A siding application and gauge tool with a knife edge extending downwards from a top ridge for insertion behind the prior course of siding. The top ridge is of sufficient length to fit over the top edge of said prior course of siding. An overlap section extending downward from said top ridge is the exact same length as the overlap of the next course of siding. The support section contains a stop for holding the siding in an upright position. The support section, with a lip at one end, is the exact length of the exposed width of the prior course.

It is an object of this invention to increase productivity in the application of siding.

It is a further object to provide an invention which precisely measures the overlap width and the exposed width of siding.

It is another object to provide an inexpensive, long lasting tool.

It is a final object to provide an easily insertable and removable tool when applying siding.

DETAILED DESCRIPTION OF THE PREFERRED EMBODIMENT

Figure 1:
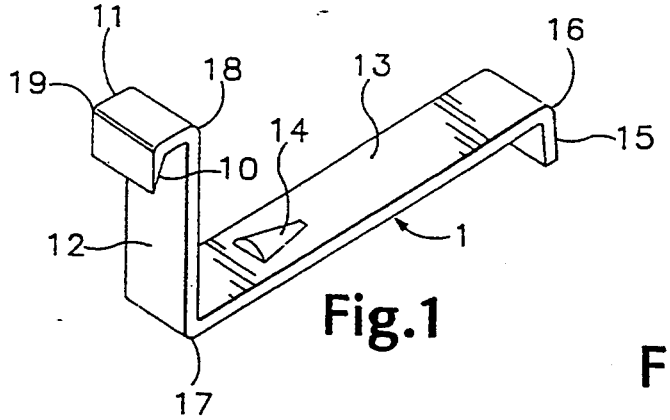
FIG. 1 is a perspective view of the invention.
Figure 3:
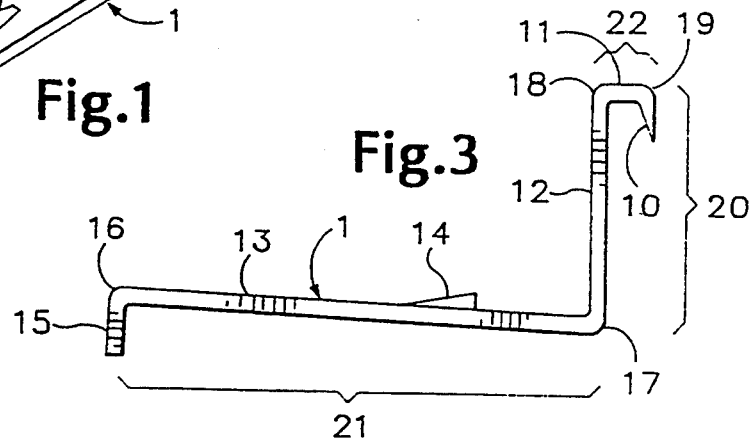
FIG. 3 is a side view of the invention.
Figure 2:
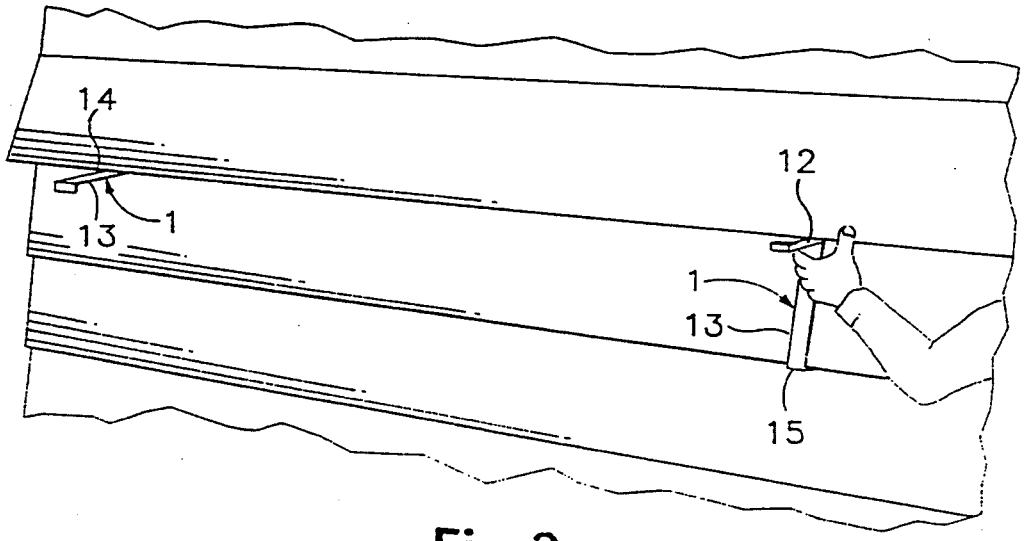
FIG. 2 is a perspective view of the invention in use.

The siding application and gauge tool 1 can be made of any material, however, spring steel is preferred because of the accuracy of bending and durability of the material. The tool 1 is made of one piece of material with bends. The knife edge 10 is made thin enough to slip between attached siding of any shape and exterior wall and is the full width of the tool 1. The knife edge

10 extends in a generally downward direction from the top ridge 11 through knife edge bend 19. The top ridge 11 is of length such that it slides over the top of siding. The length is shown as siding thickness width 22. The overlap section 12 extends downward from the top ridge 11 by means of a overlap bend 18. The length of overlap section 12 is denominated as overlap length 20. The support section 13 is formed by support bend 17. The exposed width 21 is the length of the support section 13. A stop 14 is provided to the support section 13 to prevent siding from sliding off the tool 1. Lip 15 extends from one end of the support section 13 by means of lip bend 16.

Figure 4:
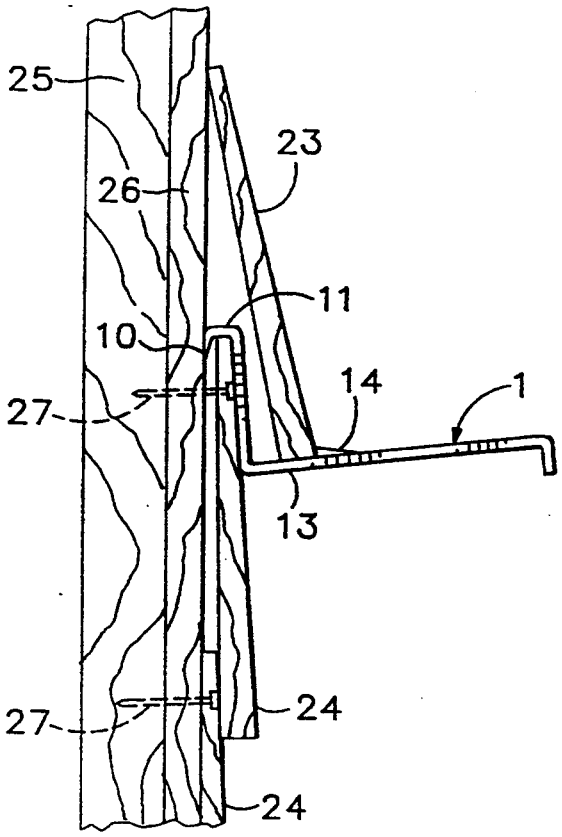
FIG. 4 is a side view of the invention inserted in the siding.
Figure 5:
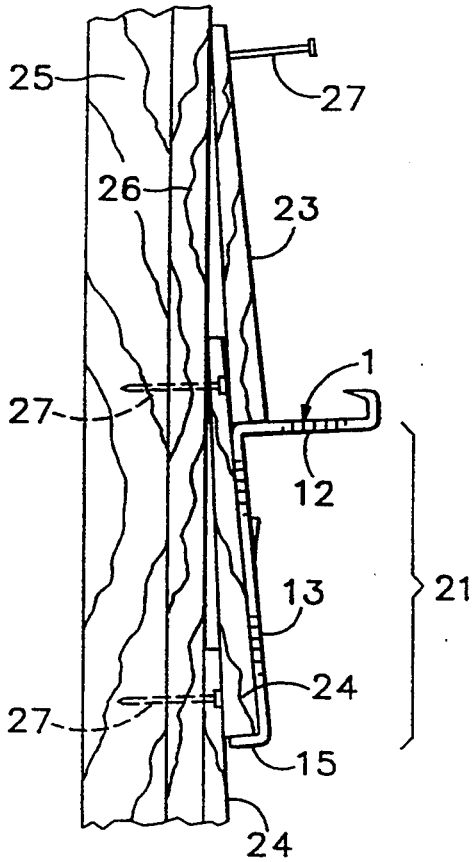
FIG. 5 shows the support section used a gauge.

FIGS. 4 and 5 show the substructure. Stud 25 has sub siding 26 attached along with the siding 24 held by nails 27. Previously attached siding 24 is shown.

The method of applying siding which uses the following steps:

Step 1: Snapping a chalk line for first course of siding;

Step 2: Attach first course of siding along chalk line;

Step 3: Place first siding application and gauge tool over top of first course near one end;

Step 4: Place second course of siding on tool material support section,

Step 5: Use support section of second applicating and gauge tool at the opposite end of first course of siding, Step 6: Hold lip against bottom of first course, nail end of siding at gauge.

Step 7: Use second tool and nail siding working towards first applicating tool.

Step 8: Remove first tool, use second tool, complete nail process.

Step 9: Place first tool on the top of second course near one end and repeat steps 3 through 8 until all courses are completed.

I claim:

1. A siding application tool comprising:

an elongate member having a first end, a second end and an upper surface;

a lip at the first end extending outwardly in a first direction at a substantially orthogonal angle from the upper surface, said lip being substantially planar without bends or attachments;

an overlap section at the second end extending outwardly in a second direction substantially opposite the first direction, where the overlap section includes a first side facing the first end; and a hook positioned on the overlap section away from the elongate member's second end, where the hook includes a segment hooking away from the overlap section's first side.

2. A method of applying courses of siding to a wall by using two siding application tools, each tool comprising an elongate member having a first end, a second end, an upper surface, a lip at the first end extending outwardly in a first direction at a substantially orthogonal angle from the upper surface, an overlap section at the second end extending outwardly in a second direction substantially opposite the first direction, where the overlap section includes a first side facing the first end, and a hook positioned on the overlap section away from the elongate member's second end, where the hook includes a segment hooking away from the overlap section's first side, and where each course of siding includes a first end, a second end, a bottom edge, a top edge and a front surface, the method comprising the steps of:

attaching a first course of siding to the wall;

hooking the hook of a first siding application tool over the top edge and toward the first end of the first course so that the tool's elongate member extends outwardly from the course's front surface;

resting the first end of a second course of siding on the elongate member of the first tool;

positioning the lip of a second siding application tool over the bottom edge and toward the second end of the first course so that the tool's elongate member extends upwardly over the first course;

supporting a portion of the second course with the second tool's overlay section;

securing the portion of the second course that is adjacent the second tool to the wall;

sliding the second tool toward the first end of the first course;

affixing the portion of the second course that is now adjacent the second tool to the wall;

repeating the steps of sliding and affixing until the second tool is adjacent the first tool;

detaching the first tool from the first course;

again repeating the steps of sliding and affixing until the second course is completely affixed to the wall; and removing the second tool from the first course of siding.

* * * * *